US005968700A

United States Patent [19]

Tyagi et al.

[11] Patent Number: 5,968,700

[45] Date of Patent: Oct. 19, 1999

[54] TONER COMPOSITIONS INCLUDING CROSSLINKED POLYMER BINDERS

[75] Inventors: Dinesh Tyagi, Fairport; Richard L. Hadcock, Rochester, both of N.Y.

[73] Assignee: Eastman Kodak Company, Rochester, N.Y.

[21] Appl. No.: 09/016,065

[22] Filed: Jan. 30, 1998

Related U.S. Application Data

[63] Continuation-in-part of application No. 08/657,473, May 29, 1996, abandoned

[60] Provisional application No. 60/001,632, Jul. 28, 1995.

[51] Int. Cl.[6] ..... G03G 9/097; G03G 9/089

[52] U.S. Cl. ..... 430/110; 430/109; 430/137

[58] Field of Search ..... 430/110, 109, 430/137, 904

[56] References Cited

U.S. PATENT DOCUMENTS

| | | |
|---|---|---|
| Re. 31,072 | 11/1982 | Jadwin et al. . |
| 2,229,513 | 1/1941 | Lustig . |
| 3,547,822 | 12/1970 | Miller . |
| 3,632,512 | 1/1972 | Miller . |
| 3,795,618 | 3/1974 | Kasper . |
| 3,850,663 | 11/1974 | Hagenbach . |
| 3,893,935 | 7/1975 | Jadawin et al. . |
| 3,898,170 | 8/1975 | Kasper . |
| 3,938,992 | 2/1976 | Jadwin et al. . |
| 3,970,571 | 7/1976 | Olson et al. . |
| 4,042,518 | 8/1977 | Jones . |
| 4,076,857 | 2/1978 | Kasper et al. . |
| 4,079,014 | 3/1978 | Burness et al. . |
| 4,089,472 | 5/1978 | Siegel et al. . |
| 4,160,644 | 7/1979 | Ryan . |
| 4,323,634 | 4/1982 | Jadwin . |
| 4,394,430 | 7/1983 | Jadwin et al. . |
| 4,414,152 | 11/1983 | Santilli et al. . |
| 4,416,965 | 11/1983 | Sandhu et al. . |
| 4,473,628 | 9/1984 | Kasuya et al. . |
| 4,478,925 | 10/1984 | Miskinis . |
| 4,517,272 | 5/1985 | Jadwin et al. . |
| 4,546,060 | 10/1985 | Miskinis et al. . |
| 4,624,907 | 11/1986 | Niimura et al. . |
| 4,683,188 | 7/1987 | Suzuki et al. . |
| 4,726,994 | 2/1988 | Yoerger . |
| 4,758,491 | 7/1988 | Alexandrovich et al. . |
| 4,780,553 | 10/1988 | Suzuki et al. . |
| 4,814,250 | 3/1989 | Kwarta et al. . |
| 4,833,060 | 5/1989 | Nair et al. . |
| 4,834,920 | 5/1989 | Bugner et al. . |
| 4,840,864 | 6/1989 | Bugner et al. . |
| 4,894,309 | 1/1990 | Georges et al. ..... 430/137 |
| 5,192,637 | 3/1993 | Saito et al. . |
| 5,247,034 | 9/1993 | Mate et al. . |

FOREIGN PATENT DOCUMENTS

| | | |
|---|---|---|
| 797132 | of 0000 | Belgium . |
| 1420839 | 1/1976 | United Kingdom . |
| 1501065 | 2/1978 | United Kingdom . |

OTHER PUBLICATIONS

*Electrophotography and Development Physics* by L. B. Schein, Springer–Verlag, NY (1985), pp. 168–173.

*Primary Examiner*—Christopher D. Rodee
*Attorney, Agent, or Firm*—Doreen M. Wells

[57] ABSTRACT

There is provided a toner composition which comprises a binder made from (A) a copolymer selected from (1) a vinyl aromatic monomer; a second monomer selected from the group consisting of i) conjugated diene monomers and ii) acrylate monomers selected from the group consisting of alkyl acrylate monomers and alkyl methacrylate monomers; and a third monomer which is a crosslinking agent; and (2) polyesters of aromatic dicarboxylic acids with one or more aliphatic diols; and (B) an alkyl sarcosine or a salt thereof having an alkyl group which contains from about 10 to about 20 carbon atoms.

20 Claims, No Drawings

TONER COMPOSITIONS INCLUDING CROSSLINKED POLYMER BINDERS

CROSS REFERENCE TO RELATED APPLICATIONS

This application is a continuation-in-part of U.S. Ser. No. 08/657,473 filed May 29, 1996,now abandoned and claims the benefit of U.S. Provisional application Ser. No. 60/001,632 filed Jul. 28, 1995.

FIELD OF THE INVENTION

The invention relates to toner compositions including a binder. The toner compositions are suitable for use in electrophotographic processes.

BACKGROUND OF THE INVENTION

In electrophotography (sometimes more generally referred to as electrostatography), an image comprising a pattern of electrostatic potential (also referred to as an electrostatic latent image), is formed on a surface of an electrophotographic element and is then developed into a toner image by contacting the latent image with an electrographic developer. If desired, the latent image can be transferred to another surface before development. The toner image is eventually transferred to a receiver, to which it is fused, typically by heat and pressure.

Toners typically contain a binder and other additives, such as colorants. Binders are generally polymeric and are selected so as to provide a balance between various conflicting constraints. For example, the melt viscosity and melt elasticity of a toner incorporating the binder must not be so low as to cause problems in transferring and fusing a toner image to a receiver.

In U.S. Pat. No. 3,938,992 there is disclosed a toner binder which is crosslinked. However, when a toner based on such a binder is used in a developer, there is an increase in the developer electrical resistance as the developer is continuously used over time to make many images. The term "developer electrical resistance" is commonly used in electrophotography to measure the electrical resistance of the developer wherein the developer comprises toner and carrier particles. The developer electrical resistance is an indication of the magnitude of the electrical field across the carrier and the photoconductor surface when a certain development voltage is applied across the toning shell. The conductivity of a developer is also helpful in removing the counter charge present on the carrier surface once the toner has been developed to the photoconductor surface. The theoretical discussion of developer electrical resistance in conductive magnetic brush development is described in pages 168 through 173 of *Electrophotography and Development Physics* by L. B. Schein, Springer-Verlag, NY.(1985).

The increased electrical resistance leads to a decrease in the electric field between the toning station and the photoconductive element which results in the transfer of less toner to the photoconductive element for a given charge, and therefore, decreased toner density, "line thinning", or the tendency of alpha numeric characters to become less legible in the fused toner images. Further, these binders have a limited wettability to several compounds which are useful toner addenda, such as iron oxide.

In U.S. Pat. No. 4,473,628, Kasuya et al. discloses a toner composition made from a binder resin produced by emulsion polymerization of butadiene, styrene, and divinyl benzene as a dispersion in water with emulsifiers and initiators. That binder resin is a mixture of two resins, each having different characteristics—one having a low weight average molecular weight, the other a high weight average molecular weight.

Kasuya does not teach a cross-inked polymer but instead teaches the use of high levels of a chain transfer agent (t-dodecyl mercaptan) in conjunction with divinyl benzene) in the preparation of the binder resin (See Example 1, col. 4), a practice known in the art to lower the molecular weight of the polymer as well as prevent the formation of an insoluble (gel) fraction. Such a binder would have certain disadvantages as discussed below.

Cross-linking is desired to impart increased fusing latitude and reduced off-set to the fuser roller despite the fact that increased melt viscosities generally cause deterioration of the fusing properties. Also, cross-linking is desired to reduce the gloss of the fused image.

The incorporation of an insoluble (gel) fraction in the toner binder increases its toughness. As a consequence, the toner breakage caused by mixing the toner with the carrier particles inside the developer station is minimized. Toner breakage, if generated, causes the small toner particles to adhere to the carrier surface which leads to scumming of the carrier surface and eventual rise in developer electrical resistance.

One recently disclosed binder for toner compositions is described in U.S. Pat. No. 5,247,034 (Mate). This reference discloses a binder which is prepared by an emulsion preparation technique using amino acid salts such as ammonium lauryl sarcosinate and sodium lauryl sarcosinate. While these binders are useful, they are not cross-linked and cannot be used in many toner applications in high speed machines because they have very limited fusing latitude and high gloss.

Thus, there is a continuing need for further improvements in toner binders.

SUMMARY OF THE INVENTION

In accordance with the present invention, there is provided a toner composition which comprises a binder, wherein said binder comprises A) a copolymer selected from
   (1) a vinyl aromatic monomer; a second monomer selected from the group consisting of i) conjugated diene monomers and ii) acrylate monomers selected from the group consisting of alkyl acrylate monomers and alkyl methacrylate monomers; and a third monomer which is a crosslinking agent; and
   (2) polyesters of aromatic dicarboxylic acids with one or more aliphatic diols; and B) an alkyl sarcosine or a salt thereof having an alkyl group which contains from about 10 to about 20 carbon atoms.

In preferred embodiments of the invention, the toner further comprises colorant. In other preferred embodiments, the toner further comprises charge control agent.

The toner compositions of the invention can be used with a carrier in developer compositions.

DETAILED DESCRIPTION OF THE INVENTION

The binder of the invention includes a copolymer that is made in accordance with the process described in U.S. Pat. No. 5,247,034, incorporated herein by reference, except that the copolymer includes a crosslinking agent. The advantages of using a crosslinking agent to produce the toner compositions of the invention are several. The toners of the invention provide an extended fusing temperature latitude. Therefore, adequate fusing quality and good toner release from the fusing roller is achieved over a broad temperature range. In many applications, the toners made according to '034 cannot be successfully fused without fuser roller off-set. Further, toner images with high gloss are achieved even when fusing is successful with the binders of '034. Still further, with the toners of the invention, there is reduced increase in the developer electrical resistance over time compared to compositions using other binders, for example the binders disclosed in U.S. Pat. No. 3,938,992, thus leading to more uniform density over time, and reduced "line thinning" in the fused toner images. Still further, the compositions of the invention have excellent keeping characteristics, particularly at elevated temperature.

Among the binders that are useful in the invention are copolymers of vinyl aromatic monomers; conjugated dienes or acrylate monomers; and crosslinking agents (and combinations thereof).

The useful vinyl aromatic monomers include styrene, 1-vinyl naphthalene; 2-vinyl naphthalene; 3-methyl styrene; 4-propyl styrene; t-butyl styrene; 4-cyclohexyl styrene; 4-dodecyl styrene; 2-ethyl-4-benzyl styrene; 4-(phenylbutyl) styrene; divinylbenzene and similar monomers.

The alkyl acrylate monomers that can be used generally have the structural formula:

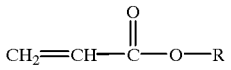

wherein R represents an alkyl group containing from 1 to about 10 carbon atoms. The alkyl group in such alkyl acrylate monomers will preferably contain from 2 to about 8 carbon atoms with alky groups which contain 4 carbon atoms being most preferred. Accordingly, ethyl acrylate, propyl acrylate, butyl acrylate, pentyl acrylate, hexyl acrylate and 2-ethyl acrylate are preferred. Most preferred is butyl acrylate.

The alkyl groups in such alkyl acrylate monomers can be straight chained or branched. Thus, normal-propyl acrylate, iso-propyl acrylate, normal-butyl acrylate or tertiary-butyl acrylate monomers can be used. Normal-butyl acrylate is the currently preferred alkyl acrylate monomer.

The alkyl methacrylate monomer that can be used normally has alkyl groups which contain from 1 to about 20 carbon atoms. The alkyl methacrylate monomer will preferably have an alkyl group which contains from 2 to about 12 carbon atoms. Some representative examples of alkyl methacrylate monomers include methyl methacrylate, butyl methacrylate, 2-ethylhexyl methacrylate, lauryl methacrylate and similar monomers.

The conjugated diene monomers which can be used typically contain from about 4 to about 10 carbon atoms. As a general rule, the conjugated diene monomer will contain from 4 to about 6 carbon atoms. Isoprene and 1,3-butadiene are the currently preferred conjugated diene monomers.

The crosslinking agent contains one or more compounds each having two or more double bonds capable of polymerization. Examples of suitable crosslinkers include: aromatic divinyl compounds such as divinyl benzene, and divinyl naphthalene; carboxylic acid esters having two double bonds such as ethylene glycol diacrylate, ethylene glycol dimethacrylate, and 1,3-butane diol dimethylacrylate; divinyl compounds such as divinyl aniline, divinyl ether, divinyl sulfide, and divinyl sulfone; and compounds having three or more vinyl groups.

Also useful in the invention are polyesters of aromatic dicarboxylic acids with one or more aliphatic diols such as polyesters of isophthalic or terephthalic acid with diols such as ethylene glycol, cyclohexane dimethanol and bisphenols.

The described crosslinked binder useful in this invention preferably has a tetrahydrofuran (THF) insoluble fraction ranging from 5 percent to 75 percent by weight of the entire binder. The range of insoluble fraction present in the binder would determine the fusing quality obtained with the resulting toner as well as the gloss levels observed on fused images. Most importantly, the melt rheological behavior of the toner which is influenced by its insoluble fraction, determines the hot off-set propensity of the toner. (Hot off-set refers to the unwanted transfer of the toner melt to the fuser member.) The rheological requirements for a toner melt are affected by the type of fusing sub-system geometry, type of materials selected for fuser surface and the fusing speed. The rheological behavior of the polymer can be very easily performed on a dynamic mechanical rheometer. The results obtained on these binder at 150° C. and 1 rad/sec frequency indicate that the preferred complex melt viscosity (eta*) is in the range of 10,000 to 300,000 poise. Under similar conditions the storage modulus (G') would range from 5,000 to 275,000 dyne/cm$^2$. The higher the melt storage modulus, higher is the melt elasticity for the resulting toner.

The need for high melt elasticity toners is essential for obtaining toner compositions which have reduced hot off-set properties. The rheological characteristics of a toner melt are also essential for controlling the gloss level achieved in a fused image. The rheological parameter which is most useful for predicting the gloss level achievable for a fused image is the dissipation factor. The dissipation factor for a toner melt can be characterized by its tan δ values. The tan δ value is the ratio of loss and storage moduli. The low tan δ values would be an indication of higher elastic component of the toner resin and can be used to describe the higher extent of polymer memory present and longer polymer relaxation time. The amount of polymer memory would affect the resulting gloss level on a fused image. The range of tan δ useful for describing these copolymer resins is 0.35 to 2.25. Obviously, the lower tan δ values indicate higher THF insoluble fraction present in the toner resin.

The fraction of these cross-linked copolymer toner resins which is soluble in THF can be characterized by size exclusion chromatography or gel fraction analysis. The number average polystyrene equivalent molecular weight of the soluble portion of these polymers ranges from 5,000 to 25,000. The largest peak in the molecular weight distribution curves would correspond to a peak molecular weight of 8,000 to 50,000.

A suitable method for gel fraction analysis involves combining the binder and spectral grade TBF so as to produce a 1% solution of the binder which is stirred overnight. The resulting solution is then ultracentrifuged at 20,000 rpm for 3 hours and the supernatant is removed from the centrifuge tubes. About 5 grams of the supernatant is poured into a weighed aluminum dish and allowed to dry under vacuum at 80° C. The percentage of the binder that is insoluble (the "insoluble fraction" or "gel fraction") is determined by measuring the difference in the amount of dried polymer obtained in the dish and the amount obtained from a 1% solution.

Molecular weight distribution can be done using size exclusion (gel permeation) chromatography. The same supernatant as is used for measuring the insoluble fraction can be used. A calibration curve can be prepared using polystyrene standards. Data is truncated below 37 mL elution volume to eliminate the very small molecular weight fractions in the polymer which might be due to the recombination product of the initiator.

The desired solubility and molecular weight properties can be achieved by variations in the method of making the polymer binders, by varying not only the monomer proportions but the concentration of chain transfer agent, the crosslinking agent, the initiator, the temperature, and combinations thereof. All of these adjustments can be easily made by those of skill in the polymer synthesis art to achieve the desired properties as set forth above.

Particularly preferred crosslinked polymer binders according to the invention are shown in "Table A" just preceding the examples.

The copolymer binders that are useful in the invention can be made in the presence of an amino acid soap and this component is left behind in the binder and toner composition following isolation of the binder by appropriate methods. The preferred isolation method is by the addition of an acid, most preferably sulfuric acid, to form the acid form of an amino acid soap, which becomes part of the toner composition.

The amino acid soaps are typically salts of alkyl sarcosines. The alkyl sarcosine will typically have an alkyl group which contains from 10 to about 20 carbon atoms. Salts can be readily formed by reacting the alkyl sarcosines with an appropriate base, such as sodium, potassium, ammonium hydroxide, monoethanol amine, diethanol amine or triethanol amine. As a general rule, it is preferred to use sodium alkyl sarcosinates. Some representative examples of sodium alkyl sarcosinates which can be used include sodium lauryl sarcosinates, sodium cocyl sarcosinates, sodium myristol sarcosinates sodium oleoyl sarcosinates sodium stearyl sarcosinates and similar sarcosinates. Sodium lauryl sarcosinate is a particularly preferred amino acid soap for the compositions of the invention. Sodium lauryl sarcosinate is commercially available from W. R. Grace and Company as Hamposyl® L-30.

The amount of amino acid soap is as described in U.S. Pat. No. 5,247,034 at column 5. That is, the amount is preferably between about 0.5% to about 6% by weight of the binder, the remainder of the binder being essentially the copolymer as described. At amino acid soap concentrations below 0.5%, the advantageous effects, such as the resistance control, of a developer using the toner of the invention are greatly diminished. At concentrations above 6%, no further advantages are seen in the performance of the toner composition. The currently preferred range is from about 1% to about 2% by weight of the binder.

Above, a process is described wherein the alkyl sarcosine or salt thereof can be added in situ during binder polymerization. Alternatively, the alkyl sarcosine or salt thereof can be later added directly to a toner composition which comprises a binder polymerized in its absence. In that case, the alkyl sarcosine or salt thereof can be added in the same amounts described above as a toner ingredient during the toner melt compounding process.

The toner preferably comprises colorant: a pigment or dye or other additives which color the toner in a final image. Suitable dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. Clear toners of this invention comprise no colorant.

A preferred but optional additive is a charge control agent. The term "charge control" refers to a propensity of a toner addenda to modify the triboelectric charging properties of the resulting toner. A very wide variety of charge control agents for positive charging toners are available. A large, but lesser number of charge control agents for negative charging toners are also available. Suitable charge control agents are disclosed, for example, in U.S. Pat. Nos. 3,893,935; 4,079,014; 4,323,634; 4,394,430 and British Patents 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Particularly preferred charge control agents are shown in "Table B" immediately preceding the examples.

The toner can contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis. In the case of MICR (magnetic ink character recognition) toners, the weight percent of iron oxide could be as high as 40% by weight. In a particular embodiment of the invention, a waxy or olefinic additive is used at a concentration of about 0 to 5 weight percent relative to the weight of binder. A preferred additive of this type is a low molecular weight polypropylene wax such as a commercially available wax from Sanyo Chemical Corporations under the trade name Viscol®.

The developers of the invention can include a carrier and toner. Carriers can be conductive, non-conductive, magnetic, or non-magnetic: Carriers are particulate and can be glass beads; crystals of inorganic salts such as aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. No. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; and 3,970,571; and 4,726,994. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles.

In an embodiment of the invention, the carrier can be strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. Pat. No. 5,411,832 of William E. Yoerger, which is hereby incorporated herein by reference. The fluorocarbon carrier is also referred to herein as "modified Kynar".

Toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The polymer binder used in the invention can be melt processed in a two roll mill or extruder. This procedure can include melt blending of other materials with the polymer, such as toner addenda and colorants. Addenda may also include an alkyl sarcosine or salt thereof if the binder being used was polymerized in its absence. A preformed mechanical blend of particulate polymer particles, colorants and other toner additives can be prepared and then roll milled or extruded. The roll milling, extrusion, or other melt processing is performed at a temperature sufficient to achieve a uniformly blended composition. The resulting material, referred to as a "melt product" or "melt slab" is then cooled. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is cooled and then pulverized to a volume average particle size of from about 5 to 20 micrometers. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

The term "particle size" used herein, or the term "size", or "sized" as employed herein in reference to the term "particles ", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The particulate material produced by the pulverization has a substantially uniform volume average particle size and a polymer composition that differs from the polymer produced by the polymerization step. The molecular weight distribution is shifted. The original peak seen on molecular exclusion chromatography remains present. (The peak may have a slight change in amplitude or a slight shift in concentration.) The gel fraction or the high molecular weight soluble material is diminished and replaced by an intermediate molecular weight peak.

In a preferred embodiment of the invention, the carrier is sponge iron, which is sieved, oxidized and coated with fluorocarbon on a 0.2 weight percent basis.

In a particular embodiment, the developer of the invention contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer can be made by simply mixing the toner and the carrier in a suitable mixing device. The components are mixed until the developer achieves a maximum charge. Useful mixing devices include roll mills and other high energy mixing devices.

The developer of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After image-wise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The "SDS prepared" binder mentioned in the examples refers to a binder made according to the teaching of U.S. Pat. No. 3,938,992, incorporated herein by reference, using sodium dodecyl sulfate incorporated herein by reference. A number of polymeric binders were made which are useful in the practice of the invention and these are detailed in Table "A". Under "Composition" there is given the vinyl aromatic monomer, the alkyl acrylate monomer and the proportions of each. The polymer also contained a crosslinking agent. In each case, the crosslinking agent was divinyl benzene. The "% Insol." is the percentage of the polymer binder that was insoluble in tetrahydrofuran (THF). Except where noted, the binder compositions also included an alkyl sarcosinate in an amount of about 2% by weight. Thus, binders "I", "J", and "K" are comparative binders since they either were not crosslinked ("I") or they did not include an alkyl sarcosinate ("J" and "K").

TABLE A

Polymer Binders

| Binder | Composition | % Insol. | Amino Acid Soap (alkyl sarcosinate) |
|---|---|---|---|
| A | Styrene-Butyl acrylate (78/22) | 47 | Yes |
| B | Styrene-Butyl acrylate (78/22) | 33 | Yes |
| C | Styrene-Butyl acrylate (78/22) | 27 | Yes |
| D | Styrene-Butyl acrylate (78/22) | 73 | Yes |
| E | Styrene-Butyl acrylate (78/22) | 8 | Yes |
| F | Styrene-Butyl acrylate (78/22) | 63 | Yes |
| G | Styrene-Butadiene (83/17) | 45 | Yes |
| H | Styrene-Butadiene (83/17) | 30 | Yes |
| I | Styrene-Butyl Acrylate (78/22) (Made without divinyl benzene. Linear) | 0 | Yes |
| J | Styrene-Butyl Acrylate (77/23) (Made with SDS) | 45 | No |
| K | Styrene-Butyl Acrylate (Made with rosin acid soap) | 48 | No |

TABLE A-continued

Polymer Binders

| Binder | Composition | % Insol. | Amino Acid Soap (alkyl sarcosinate) |
|---|---|---|---|
| L | Image Polymers Amatex XPE 1956 (Bisphenol A Polyester) | 28 | No |
| M | Kao's Polyester Binder G (Bisphenol A Polyester) | 10 | No |

In the examples, various charge control agents are used. The charge control agents are generically described in Table "B". These charge control agents are, for the most part, commercially available.

TABLE B

Charge Control Agents

| Agent | Description | U.S. Pat. No. |
|---|---|---|
| CCA-1 | octadecyl dimethylbenzyl ammonium chloride | 4,394,430 |
| CCA-2 | dodecylbenzyl dimethyl ammonium 3-nitrobenzene sulfonate | 4,834,920<br>4,840,864 |
| CCA-3 | Mixture of sodium dioctylsulfosuccinate and sodium benzoate | 4,814,250 |
| CCA-4 | 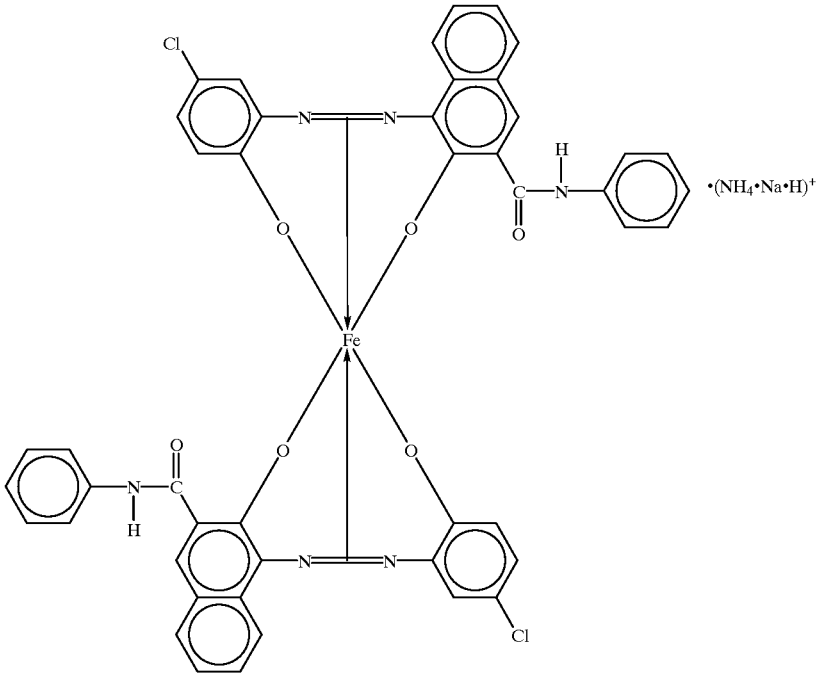 | 4,624,907 |
| CCA-5 | 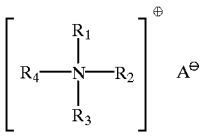 | 4,683,188<br>4,780,553 |

TABLE B-continued

Charge Control Agents

| Agent | Description | U.S. Pat. No. |
|---|---|---|
| CCA-6 | 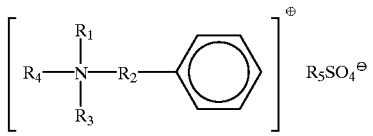 | 4,654,175<br>4,826,749<br>4,931,588 |

EXAMPLE 1

A toner sample was formulated by compounding 100 parts of cross-linked styrene-butyl acrylate copolymer (Binder A) with 6 parts Black Pearls 430 carbon black (Cabot Corporation, Boston Mass.) with 1.5 parts of dimethyl stearyl ammonium benzyl chloride charge control agent (CCA-1). The copolymer was prepared by an emulsion polymerization method. The melt extrudate was prepared in a 90 mm twin screw extruder manufactured by Werner and Pfleiderer Corporation of Ramsey, N.J. at 225° C. The feed rate for extruder was maintained at 500 Kg/hr. The resulting melt extrudates were pulverized to yield an average particle size of approximately 12 microns.

In a similar manner, a number of other formulations were prepared, including comparative formulations. All of the formulations are summarized in Table 1 below. In the table, it is shown that several compositions had more than one charge control agent (CCA). Where no charge control agent is shown, none was used. The "%C" is the weight percent of the carbon colorant in the final composition. The key for the binder used can be found in Table "A" and the key for the charge control agent can be found in Table "B". The "C" before an example number indicates a Comparative Example.

TABLE 1

Toner Compositions of the Invention and Comparative Compositions

| Ex. | Binder | CCA | % C | Other Additive |
|---|---|---|---|---|
| 1 | A | CCA-1<br>1.5 pph | 6 | |
| C1-A | J | CCA-1<br>1.5 pph | 6 | |
| C1-B | K | CCA-1<br>1.5 pph | 6 | |
| 2 | A | | 10 | 28% Iron Oxide |
| C2 | J | | 10 | 28% Iron Oxide |
| 3 | A | CCA-5<br>1.5 pph | 6 | |
| C3-A | I | CCA-5<br>1.5 pph | 6 | |
| C3-B | I | CCA-5<br>1.5 pph | 6 | 2% Wax |
| 4 | A | CCA-3<br>1.5 pph | 10 | |
| C4 | J | CCA-3<br>1.5 pph | 10 | |
| 5 | A | CCA-4<br>1.5 pph<br>CCA-2<br>1.0 pph | 10 | |
| C5 | J | CCA-4<br>1.5 pph<br>CCA-2<br>1.0 pph | 10 | |

TABLE 1-continued

Toner Compositions of the Invention and Comparative Compositions

| Ex. | Binder | CCA | % C | Other Additive |
|---|---|---|---|---|
| 6 | A | CCA-3<br>1.5 pph<br>CCA-2<br>1.0 pph | 10 | |
| C6 | J | CCA-3<br>1.5 pph<br>CCA-2<br>1.0 pph | 10 | |
| 7 | B | CCA-1<br>1.5 pph | 6 | |
| 8 | B | CCA-1<br>1.5 pph | 6 | |
| 9 | B | CCA-5<br>1.5 pph | 6 | |
| 10 | C | CCA-1<br>1.5 pph | 6 | |
| 11 | D | CCA-1<br>1.5 pph | 6 | |
| 12 | E | CCA-2<br>1.0 pph | 6 | |
| 13 | F | CCA-4<br>1.25 pph | 6 | |
| 14 | G | CCA-5<br>2.0 pph | 6 | 28% Iron Oxide |
| 15 | H | CCA-4<br>2.0 pph | 6 | 28% Iron Oxide |
| 16 | G | None | 6 | 28% Iron Oxide |
| 17-1 | L | CCA-1<br>1.5 pph | 6 | 2% Ammonium LS |
| 17-2 | L | " | " | 2% Sodium LS |
| 17-3 | L | " | " | 2% LS |
| C17 | L | " | " | None |
| 18-1 | M | " | " | 2% Ammonium LS |
| 18-2 | M | " | " | 2% Sodium LS |
| 18-3 | M | " | " | 2% LS |
| C18 | M | " | " | None |

Results

A positively charging developer was prepared using the toner formulated with the preferred toner resin (Example 1) at 3 percent concentration and compared with a similarly prepared developer except that the toner binder was a commercially available polymer based also on an emulsion polymerization technique using sodium dodecyl sulfate (SDS) as the surfactant (Comparative Example C1-A). The toner based on SDS prepared binder showed an unacceptable increase in the developer electrical resistance after approximately 400,000 copies were made in an Ektaprint® 300 copier-Duplicator. The preferred toner in Example 1 gave no measurable increase in the developer electrical resistance with identical carrier particles even after 1.2 million copies.

Developer electrical resistance was measured by placing a known weight of the developer in a metal cup and by applying a certain voltage across the developer volume. The flow of the current is measured for this applied voltage and resistance is then simply determined by dividing voltage by the current measured. This is the well-known Ohm's law. The units of the developer electrical resistance are in ohms and sometimes these measurements are presented in logarithmic fashion as log-ohms.

The developer electrical resistance of various examples of the inventions are shown below in Table 2.

TABLE 2

| Example | Binder | Surfactant* | Fresh Developer Resistance (ohm) | # of Copies | Aged Developer Resistance |
|---|---|---|---|---|---|
| 1 | A | AA | $10^7$ | >1,200,000 | $10^7$ |
| C1-A | J | SDS | $10^7$ | 400,000 | $>10^9$ |
| C1-B | K | RA | $10^7$ | 350,000 | $>10^{10}$ |
| 2 | A | AA | $10^7$ | 1,400,000 | $10^7$ |
| C2 | J | SDS | $10^7$ | 300,000 | $>10^9$ |
| 4 | A | AA | $10^7$ | 1,400,000 | $10^7$ |
| C4 | J | SDS | $10^7$ | 300,000 | $>10^{11}$ |
| 5 | A | AA | $10^7$ | >500,000 | $10^7$ |
| C5 | J | SDS | $10^7$ | 300,000 | $>10^9$ |
| 6 | A | A | $10^7$ | >500,000 | $10^7$ |
| C6 | J | SDS | $10^7$ | 200,000 | $>10^9$ |
| 17-1 | L | AA | $10^7$ | 300,000 | $10^6$ |
| 17-2 | L | AA | $10^7$ | 300,000 | $10^6$ |
| 17-3 | L | LS | $10^7$ | 300,000 | $10^6$ |
| C17 | L | None | $10^7$ | 100,000 | $10^{10}$ |
| 18-1 | M | AA | $10^7$ | 300,000 | $10^7$ |
| 18-2 | M | AA | $10^7$ | 300,000 | $10^7$ |
| 18-3 | M | LS | $10^7$ | 300,000 | $10^7$ |
| C18 | M | None | $10^7$ | 100,000 | $>10^{11}$ |

AA—amino acid soap
RA = rosin acid soap
SDS = sodium dodecyl sulfate
LS = lauryl sarcosine
* = as surfactant during polymerization process; or as addendum during compounding In Table 2 above, the only difference between the Examples of this invention and Comparative Examples is that alkyl sarcosine or a salt thereof is present in the toner composition. The presence of the alkyl sarcosine in the toner examples of this invention was also verified by analytical methods.

We have found that when the developer electrical resistance, as measured above, exceeds $10^9$ ohms, the image quality is not satisfactory;. The copy images are washed out and the solid area begins not to fill in adequately. The developers based on the toners of the invention unexpectedly keep the resistance nearly constant, while the developers based on other surfactants show that resistance of developer increases by 2 to 4 orders of magnitude.

When Example 1 toner was used in the above copier, there was noticeably less dusting of the toner inside the machine; images were substantially free of unwanted background; and consistent improved image quality were obtained throughout the developer life. In addition, this toner exhibits improved keeping properties at elevated temperature and better pigment dispersion than toner described in Comparative Example C1-A. The toner in Example 1 showed less contamination of the fuser roller surface.

When a toner which is similar to that described in Example 1 except that it was based on an emulsion copolymer prepared with rosin acid soaps in place of ammonium lauryl sarcosinate (Comparative Example C1-B) was likewise tested, substantial performance improvements of Example 1 over Comparative Example C1-B were also observed for Example 1 over Comparative Example C1-B). The toner in Comparative Example C1-B showed significant increase in the developer electrical resistance after 350,000 copies; higher toner dusting inside the copier; and loss of image quality with developer life. This toner also showed poor charging rate compared to the toner in Example 1 as well as reduced image background. The term "charging rate" is used to describe how rapidly a given toner attains its maximum optimum charge when it is mixed with a particular carrier particles.

A negatively charging MICR toner was prepared using the preferred composition as described in Example 2. This toner was tested along with a similar MICR toner except that this toner was based on a polymer prepared with an emulsion polymerization method using SDS as the emulsifying agent (Comparative Example C2). The dispersion of iron oxide used in the formulation was found to be far superior in Example 1 showing better wettability of the toner addenda by the toner binder selected. Using the SDS prepared binder, the Comparative Example C2 toner composition had to be processed such that the compounding time had to be about 2–3 times the compounding time for the Example 2 to get equivalent dispersion. This is believed to be the result of the fact that the Example 2 composition was much better able to wet the iron oxide. This is a significant advantage in the manufacture of the toner composition. The magnetic signal strength of this toner was also higher than the Comparative Example C2. Two developers were prepared at 3 percent toner concentration with both toners using stainless steel carrier particles and tested in an Ektaprint® 1392 printer. The Comparative Example C2 had unacceptable developer electrical resistance within 300,000 copies where as the developer based on Example 2 showed no observable developer electrical resistance change in a longer run.

Significant improvements in the hot toner off-set characteristics were obtained with a cross-inked resin over an uncrosslinked binder. The toner in Example 3 and Comparative Examples C3-A & C3-B were all based on the polymer binder of the '034 patent except that there was no crosslinked fraction present in both comparative examples. The Comparative Examples, C3-A and C3-B are similar except that the latter contains an additional amount of a low molecular weight polypropylene wax as a release aid. With Comparative Example C3-A, there was no temperature at which adequate fusing was achieved without observing any hot-off-set to the fuser roller surface in an Ektaprint(D 300 Copier-Duplicator. For the Examples of the invention, in each case, the crosslinked toner resin provided adequate fusing with no onset of any hot off-set to the fuser roller up to 240° C. These cross linked toner binders not only provide the improved fusing latitude, but the toner based on these preferred binders exhibit unprecedented control of the developer electrical resistance; faster charging rate; improved wettablity of toner addenda; as well as improved keeping behavior.

In an electrophotographic machine which is equipped with a low surface energy Teflon® fuser roller surface and an indexing oiling/cleaning web, the Comparative Example 3C-B composition exhibited adequate fusing over 40° C. latitude. The gloss of the image, as measured by Gardnier $G_{20}$ measurements, was found to be higher than 10. Under similar conditions, the composition of Example 3 continued to show no fuser roll off-set at all and gloss levels of less than 2 were obtained at all fusing conditions.

A negative charging toner was formulated with the preferred toner binder of this invention (Example 4). Another toner was prepared identically except that this Comparative Example C4 was made with SDS based emulsion polymer. Developers with these toners were prepared and tested in an Ektaprint® 1392 printer. The toner from Comparative Example C4 showed significant early life increase in developer electrical resistance (less than 300,000). By comparison, the toner described in Example 4 showed no increase in developer electrical resistance even after 1.4 million prints. In addition, to improved developer life, these toners display better charging rate; improved dispersion of toner additives; and reduced copy background. The printer was significantly clean after Example 4 toner had been used for an extended period of time. On the other hand, the use of Comparative Example C4 formulation showed poor transfer of toner from the photoconductor as well as a degradation of image quality with developer life.

Similar results were obtained when toner in Example 5 was compared to toner in Comparative Example C5 and Example 6 was compared with Comparative Example C6.

In comparison to the commercially available SDS prepared binders mentioned above, the toner compositions using the crosslinked binders as described exhibit improved keeping properties. That is, they maintain good powder characteristics over time at elevated temperature, e.g. 52° C.

A number of other toner compositions were prepared with varying melt viscosity and binder composition. The binder was in accordance with the invention. These examples are also shown in Table 1, Examples 7–16. These examples also showed results that were similar to the results from Examples 1–6.

The invention has been described in detail with particular reference to certain preferred embodiments thereof, but it will be understood that variations and modifications can be effected within the spirit and scope of the invention.

What is claimed is:

1. A toner composition which comprises a binder, wherein said binder comprises:

A) (1) a copolymer containing a vinyl aromatic monomer; a second monomer selected from the group consisting of I) conjugated diene monomers and ii) acrylate monomers selected from the group consisting of alkyl acrylate monomers and alkyl methacrylate monomers; and a third monomer which is a crosslinking agent; or (2) polyesters of aromatic dicarboxylic acids with one or more aliphatic diols; and B) an alkyl sarcosine or a salt thereof having an alkyl group which contains from about 10 to about 20 carbon atoms;

wherein said binder has a tetrahydrofuran (THF) insoluble fraction ranging from 5 percent to 75 percent by weight of the entire binder.

2. The toner composition according to claim 1 wherein said composition further comprises a charge control agent.

3. The toner composition according to claim 2 wherein said charge control agent is octadecyl dimethylbenzyl ammonium chloride.

4. The toner composition according to claim 2 wherein said charge control agent is a mixture of dodecylbenzyl dimethyl ammonium 3-nitrobenzene sulfonate and

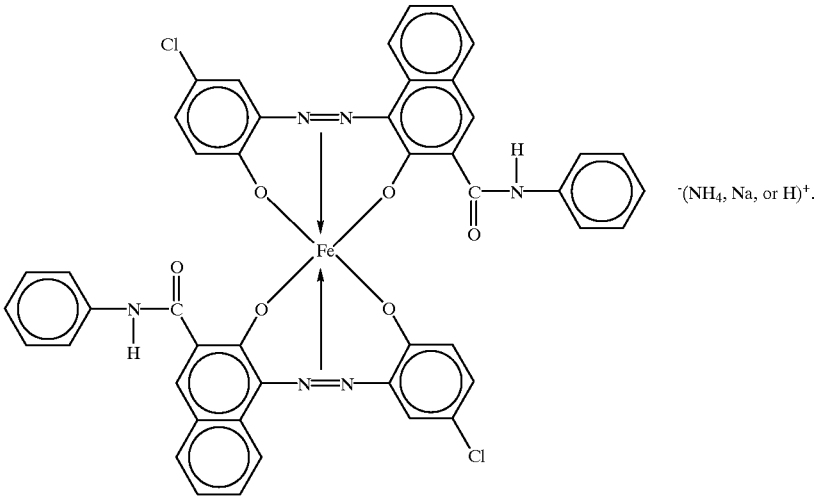

5. A developer composition comprising the toner according to claim 1 further comprising a carrier.

6. The toner composition according to claim 1 wherein said vinyl aromatic monomer is styrene and said alkyl acrylate monomer is butyl acrylate.

7. The toner composition according to claim 1 wherein said crosslinking agent is divinyl benzene.

8. The toner composition according to claim 1 wherein said alkyl sarcosine or a salt thereof is derived from sodium lauryl sarcosinate.

9. The toner composition according to claim 1 further comprising a colorant.

10. The toner composition according to claim 9 wherein said colorant is carbon.

11. The toner composition according to claim 9 wherein said composition further comprises a charge control agent.

12. The toner composition according to claim 11 wherein said colorant is carbon.

13. The toner composition according to claim 11 wherein said charge control agent is octadecyl dimethylbenzyl ammonium chloride.

14. The toner composition according to claim 11 wherein said charge control agent is a mixture of dodecylbenzyl dimethyl ammonium 3-nitrobenzene sulfonate and

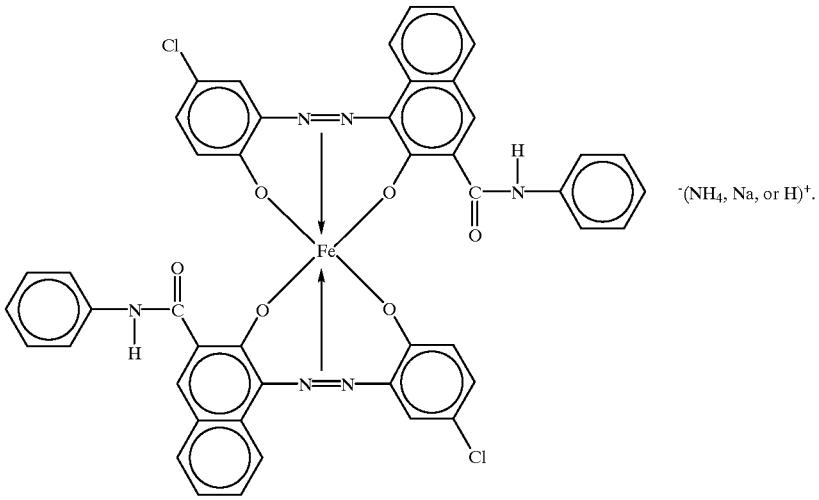

15. A developer composition comprising the toner according to claim 10 further comprising a carrier.

16. The toner composition according to claim 9 wherein said vinyl aromatic monomer is styrene and said alkyl acrylate monomer is butyl acrylate.

17. The toner composition according to claim 9 wherein said crosslinking agent is divinyl benzene.

18. The toner composition according to claim 9 wherein said alkyl sarcosine or a salt thereof is derived from sodium lauryl sarcosinate.

19. The toner composition of claim 1 wherein the dicarboxylic acid is selected from the group consisting of isophthalic and terephthalic acids.

20. The toner composition of claim 1 wherein the aliphatic diol is selected from the group consisting of ethylene glycol, cyclohexane dimethanol and bisphenols.

* * * * *